US005799955A

United States Patent [19]

Iverson

[11] Patent Number: 5,799,955

[45] Date of Patent: Sep. 1, 1998

[54] INTEGRALLY FORMED IN-LINE SKATE HAVING FLEXIBLE BOOT AND STIFF FRAME

[76] Inventor: Robert A. Iverson, 9010 Neil Lake Rd., Eden Prairie, Minn. 55347

[21] Appl. No.: 594,351

[22] Filed: Jan. 30, 1996

[51] Int. Cl.[6] ..... A63C 17/06

[52] U.S. Cl. ..... 280/11.22; 280/11.19; 280/11.3

[58] Field of Search ..... 280/11.22, 11.3, 280/11.19; 264/273, 129, 219; 425/110

[56] References Cited

U.S. PATENT DOCUMENTS

| | | | |
|---|---|---|---|
| 3,823,952 | 7/1974 | Kukulowicz | 280/11.2 |
| 3,880,441 | 4/1975 | Silver | 280/11.22 |
| 3,900,203 | 8/1975 | Kukulowicz | 280/11.2 |
| 3,901,520 | 8/1975 | McMahan | 208/7.13 |
| 3,967,832 | 7/1976 | Chambers | 280/11.12 |
| 4,034,995 | 7/1977 | Forward et al. | 280/11.23 |
| 4,040,670 | 8/1977 | Williams | 301/5.3 |
| 4,053,168 | 10/1977 | Goverde | 280/11.12 |
| 4,071,938 | 2/1978 | Chambers | 29/423 |
| 4,088,335 | 5/1978 | Norton et al. | 280/11.18 |
| 4,093,249 | 6/1978 | Chambers | 280/11.12 |
| 4,208,073 | 6/1980 | Hechinger | 301/5.3 |
| 4,262,918 | 4/1981 | Sandino | 280/11.26 |
| 4,295,655 | 10/1981 | Landay et al. | 280/11.2 |
| 4,304,417 | 12/1981 | Hsieh | 280/11.26 |
| 4,879,794 | 11/1989 | Djerf | 29/159.1 |
| 5,312,844 | 5/1994 | Gonsior et al. | 521/99 |
| 5,318,310 | 6/1994 | Laberge | 280/11.17 |
| 5,320,418 | 6/1994 | Chen | 301/5.3 |
| 5,380,020 | 1/1995 | Arney et al. | 280/11.22 |
| 5,462,295 | 10/1995 | Seltzer | 280/11.19 |
| 5,582,417 | 12/1996 | Schaper et al. | 280/11.22 |

*Primary Examiner*—J. J. Swann
*Assistant Examiner*—Michael Cuff

[57] ABSTRACT

An in-line roller skate includes a boot portion and a lower frame portion. The boot portion is fabricated of a first material that is polymeric while the lower frame portion is fabricated of a second material wherein the second material is characterized by a greater degree of stiffness than the first material. The boot and the frame portion are joined by the frame being inserted into a mold designed to form a boot portion such that when the first material is injected into the mold, the first material flows over a portion of the frame and solidifies thereover sufficiently to join the boot and the frame.

9 Claims, 4 Drawing Sheets

INTEGRALLY FORMED IN-LINE SKATE HAVING FLEXIBLE BOOT AND STIFF FRAME

BACKGROUND OF THE INVENTION

This invention pertains to in-line roller skates. More particularly, this invention pertains to methods of construction of such skates, and skates prepared according to such methods.

Since the first popularization of in-line skates in the early 1980's, in-line skating has rapidly increased in popularity and is successfully competing and co-existing with traditional roller skating. In-line skating has proven to be popular among fitness-conscious consumers, and has also generated considerable activity on a variety of competitive levels as well.

In-line roller skates generally include a plurality of wheels, mounted in-line, one behind the other, and rotatable in a common, longitudinally extending plane of rotation. The wheels are typically carried and supported by a lower frame portion attached to or integrally constructed with an in-line roller skate shoe or boot. A considerable degree of the optimal performance characteristics of an in-line roller skate is derived from the design and construction of the skate wheels. Indeed, much of the growth in popularity of in-line skating can be traced to advances in the materials and the fabrication techniques for skate wheels.

Most conventional in-line roller skates include an upper shoe (or boot) portion that is securely attached to the lower frame portion by conventional fastening means. Typically, the upper shoe portion provides the support for the skater's foot while the lower frame portion provides the rigid substructure or undercarriage for the in-line roller skate wheels.

A good deal of the popularity of in-line roller skating has resulted from the fact that the in-line wheel design results in skates that are very maneuverable and capable of higher speeds than those customarily associated with conventional paired-wheel roller skates. Consequently, in-line roller skating is generally considered to require higher levels of skill, coordination, and strength than conventional paired-wheel roller skating because of the narrower lateral support base associated with in-line roller skates. Specifically, while balancing in the forward and rear direction is relatively easy for even inexperienced skaters, balancing in the sideward or lateral direction is difficult because of the narrow support base, and is heavily dependent upon the skater's balancing and coordination skills. The requirement for such a level of skill places a premium on the design of in-line skates that provide proper ankle and foot support within the upper shoe or boot portion of the skate.

Optimum performance from an in-line roller skate depends a great deal on maintaining the skate in a substantially vertical position. At the same time, the upper skate design must provide sufficient comfort to the wearer, particularly for the non-competitive, recreational user. Thus, in the design of an in-line skate, there are competing interests for flexibility and stiffness of materials. It is desirable that the boot and skate frame be stiff in order to transmit forces from the user to the wheels during the skating action. However, flexibility is desired for comfort. Unfortunately, comfort in a shoe is not usually associated with a high degree of integral support or stiffness. In other words, the incorporation of rigid materials or rigid support structures in the upper shoe portion of an in-line roller skate tends to add stiffness and bulk, making the upper portion less comfortable for the wearer.

One approach that has been followed in the prior art, to provide lateral stability in a skate, is the adaptation of conventional alpine ski boot designs to in-line roller skates. These boot designs are advantageous in that they provide support and durability, characteristics necessary for in-line roller skates. U.S. Pat. Nos. 4,351,537 and 5,171,033 are both exemplary of rigid injection molded boots adapted to winter sports, such as ice skating and alpine skiing, which have been modified for in-line roller skating applications and both patents are hereby incorporated by reference. These patents disclose an upper boot portion, which comprises a hard plastic outer shell with a soft inner liner.

The majority of prior art designs have approached the goal of reconciling user comfort with dimensional stability through the use of multi-part construction. These designs typically include a boot and a frame joined, as mentioned above, by conventional fastening means. The multi-part design provides advantages in that the separate in-line skate components may be fabricated of widely different materials with the result that each component may be optimized for either stability or comfort. The frame which carries the wheels of the skate would be fabricated of a much harder and stiffer material in order to provide the kind of dimensional stability needed to withstand the considerable forces directed against the wheel carriage assembly of conventional in-line skates. The separately fabricated boot portion would be constructed of different materials having properties more consistent with the comfort of the user. One variation of this approach is to expand the structure and function of the typical lower frame in a monocoque construction to incorporate some of the function of the boot upper. An example of such an approach is provided in U.S. Pat. No. 5,380,020 to Arney et al., assigned at issuance to Rollerblade, Inc.

However, all of the prior art approaches involving separate fabrication of in-line skate components still display significant disadvantages. Principal among these is the requirement for mechanical fastening of the upper boot portion of the in-line skate to the lower frame portion. This requirement adds considerable complexity to the boot design and fabrication process, with attendant manufacturing costs, as well as providing a number of specific mechanical stress points for possible failure. In addition, these points of mechanical fastening between the upper and lower skate portions can also provide a potential source of discomfort points for the wearer. In the overall mechanical sense of the function of the in-line skate design, the marked interface between the stiff frame portion and the more flexible boot portion provides a less-than-ideal structure for the transmission of forces between the boot and the wheel frame that is needed for optimal control.

Attempts to more intimately fabricate separate major components of the in-line skate comprising polymeric materials of differing physical properties need to achieve both stiffness and comfort, rather than relying on simple mechanical fastening, have proven to be unsuccessful. This is due to the fundamental differences in the physical properties between the separate materials used to fabricate the upper and lower portions of the in-line skate and the effects of these different properties on the fabrication process. Conventional plastic molding techniques, as would be appreciated by one of skill in the appropriate art, are incapable of producing a unitary construction from the widely differing polymeric materials needed to address the dual goals of comfort and stiffness.

SUMMARY OF THE INVENTION

The present invention includes an in-line roller skate having a boot portion and a lower frame portion. The boot portion is fabricated of a first material that is polymeric. The lower frame portion is fabricated from a second material that is preferably polymeric and wherein the second material is characterized by a greater degree of stiffness than the first material. The boot and the frame are joined by the frame being placed in the mold designed to form a boot portion in which the first material is injected into the mold and the mold is further designed such that the first material extends over a portion of the frame sufficiently to bond the boot to the frame once the first material solidifies.

DETAILED DESCRIPTION OF THE PREFERRED EMBODIMENTS

Figure 1:
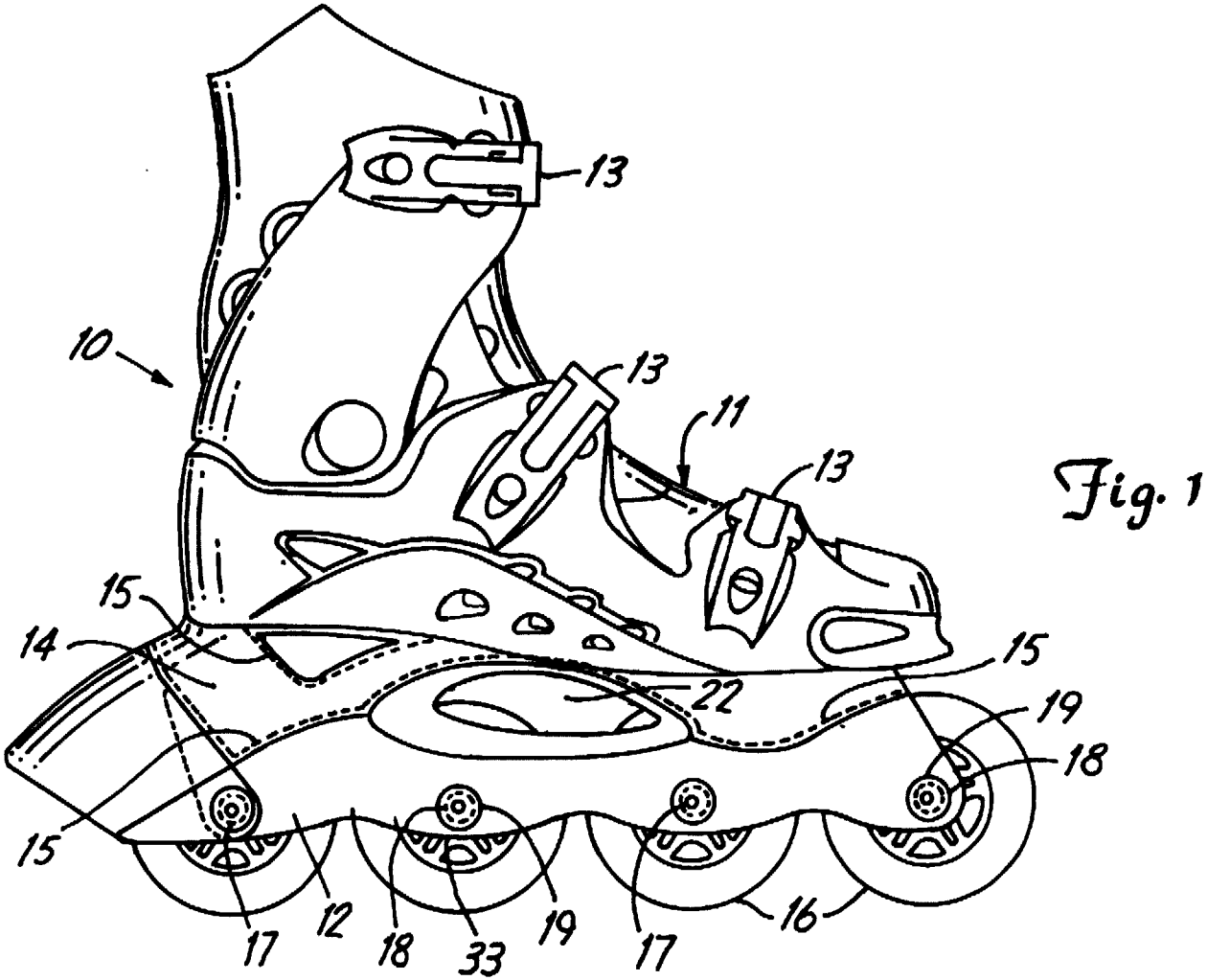
FIG. 1 is a side elevational view of an embodiment of the present invention.

Referring now to FIG. 1, there is generally depicted at 10 an in-line skate embodying the present invention. The skate 10 includes an upper boot 11, and a lower frame 12. A plurality of adjustable fasteners 13 assist in securing the upper boot 11 of the in-line skate 10 to the wearer's foot (not shown). Additional detail is also depicted in the lower frame 12 portion of the in-line skate 10. The lower frame 12 also includes an over-mold region 14 that coincides with an over-mold groove 15 (depicted in broken lines in FIG. 1). The over-mold groove 15 extends circumferentially around the exterior surface of the lower frame 12 on all four sides thereof.

The in-line roller skate of the invention includes, as also illustrated in FIG. 1, wheels 16, roller axles 17, axle seats 18 (depicted by broken lines), and wheel fasteners 19.

Figure 2:
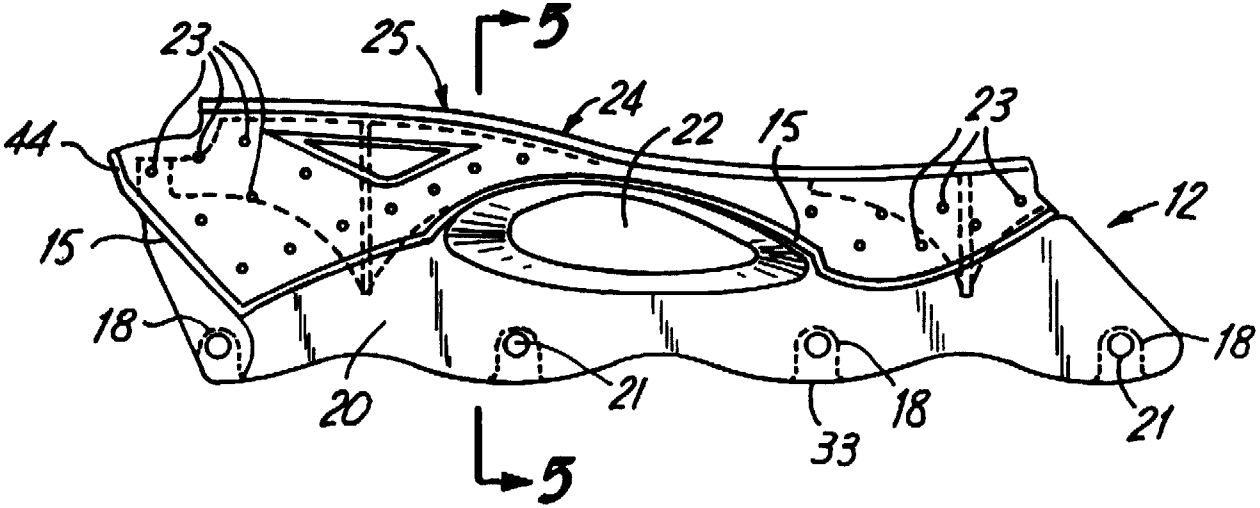
FIG. 2 is a side elevational view of an in-line skate frame of the invention prior to over-molding.
Figure 3:
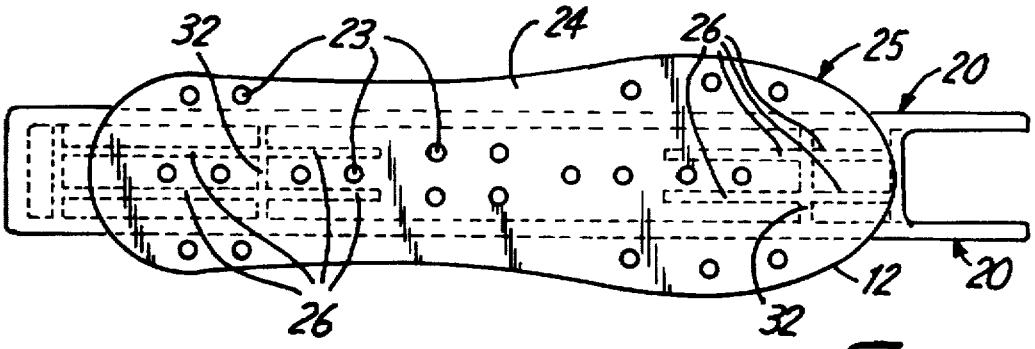
FIG. 3 is a top plan view of the frame of FIG. 2.
Figure 4:
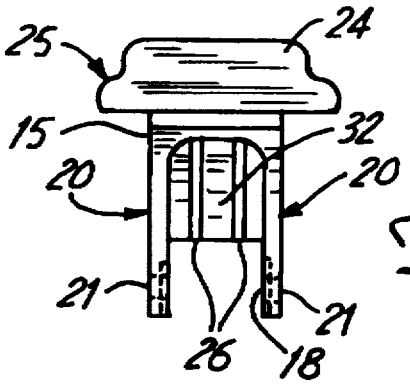
FIG. 4 is a front plan view of the frame of FIG. 2.

Referring to FIGS. 2-4, the lower frame 12 has two substantially identical, parallel, spaced apart, depending frame walls 20.

A plurality of wheel axle apertures 21 are distributed in a roughly even manner toward and along a bottom edge of the frame wall 20. The axle seats 18 are defined on an inner surface of the frame wall 20 in the form of a recess directed vertically upward from a bottom margin of the frame wall 20. The upper portion of the axle seat (recess) 18 is semi-circular with a radius slightly larger than that of axle aperture 21 and concentric therewith. The axle aperture 21 is designed to accept the wheel fastener 19.

FIGS. 1 and 2 depict an irregular oval-shaped aperture 22 through the central portion of the lower frame 12 of the in-line skate of the invention. The primary function of the aperture 22 is to remove material from the frame 12 in a region thereof that is free from any structural or functional elements of the frame 12. The end result is a reduction of the overall weight of the frame 12 without an accompanying loss of structural integrity or functional capability. The presence of the aperture 22, of course, is not essential to the design of the frame 12, and, to a certain extent, the desirability of the inclusion thereof in the design of the in-line skate 10 is dependent on the choice of polymeric material for the fabrication of the frame 12. As would be expected, stronger frame materials, such as nylon (reinforced or unreinforced) can more easily withstand the loss of such material with little or no effect on the structural or mechanical properties of the resulting frame design. The use of softer materials in the frame 12 would dictate that the decision to reduce weight through use of such an aperture 22 would be less desirable.

The continuous over-mold groove 15 runs along the entire periphery of the waist of the frame 12, extending from the front (toe) portion to the rear (brake or heel) portion of the outwardly directed side of each of the pair of frame walls 20. As depicted in FIG. 2, the groove 15 runs from the back edge of the rear-most portion of the frame 12, down toward (but not reaching) the bottom edge of the frame wall 20, continuing at an upward angle toward the front-most portion of the frame 12, tracing the upper edge of the aperture 22 through the middle portion of the frame 12. The groove 15 follows a path along the opposing frame wall 20 that is a reflection of the path shown for the wall 20, depicted in FIG. 2. In one embodiment, the groove 15 extends approximately 1.0 mm into the outer surface of the frame walls 20, and is approximately 2.0 mm in width. The precise path on the outer surface of the frame wall followed by the over-mold groove 15 is not critical to the functioning of the present invention, within some broad limits. The principal criterion for selecting the path of the over-mold groove 15 is that it be displaced sufficiently toward the bottom margin of the frame wall 20 so as to define the over-mold region 14 of sufficient area to ensure adequate mechanical and structural unity between the material of the boot 11 and that of the frame 12. In addition, the over-mold groove defines a line within the mold along which is provided a seal that prevents polymer for forming the boot from flowing further into the mold that retains the remainder of the frame.

FIG. 2 depicts a plurality of flow-through apertures 23 distributed across the over-mold region 14 through both frame walls 20 of the frame 12. The pattern of the flow-through apertures 23 is essentially random across the over-mold region 14. In the embodiment illustrated in FIG. 2, the apertures 23 are approximately 3 mm in diameter and the majority of which are spaced approximately 1.5 mm (center to center) from each other, and most spacings ranging from approximately 1.0 to 2.0 mm (center to center). The number of such flow-through apertures 23 is determined by such factors as the diameter of the apertures 23 and the materials of construction of the frame 12 and the boot 11.

The upper surface of the frame 12 defines a sole plate 25, which is best discerned in FIG. 3. The frame walls 20 are formed integral with the sole plate 25 and depend therefrom. Distributed through the sole plate 25 is a plurality of additional flow-through apertures 23. As with the similar apertures 23 in the walls 20 of the frame 12, these apertures 23 through the sole plate 25 of the frame 12 are somewhat randomly distributed across the plate 25. In the embodiment illustrated, the apertures 23 in the sole plate 25 are approximately 5 mm in diameter and are spaced (center to center) in a wider range, ranging from 1.3 to 2.7 mm from other adjacent apertures.

Two pair of forward and rearward reinforcing gussets 26, depicted in broken lines in FIG. 3, extend downwardly from the sole plate 25, between the frame walls 20. The gussets are generally parallel to each other and extend for varying lengths along the bottom surface of the sole plate. In addition, two cross braces 32 are disposed at the rearward and forward portions of the sole plate between the forward and rearward pairs of gussets 26. The cross braces 32 structurally link the frame walls 20 and the gussets 26 to stiffen the frame 12. The precise geometry and distribution of the gussets 26 will depend on the relative stiffness of the material from which the frame 12 is fabricated, and will ultimately be dictated, as would be recognized by one of skill in the relevant art, by a mechanical analysis of the stresses to which the frame 12 is subjected during the range of uses for which the in-line roller skate 10 has been designed.

With reference to FIGS. 1–4, and to the description immediately above, the functioning of the present invention will be apparent. To effectively achieve the highly desirable goal of reconciling flexibility for comfort of fit of the boot 11 and stiffness for structural integrity and optimal transmission of control forces to the frame 12 of the in-line skate 10, the boot 11 and the frame 12 are fabricated of different polymeric materials, each with characteristic physical properties leading to a desired degree of stiffness or flexibility. By way of example only, and without limitation, a preferable material for the fabrication of the boot 11 is a polyurethane that can be injection molded. The precise formulation of such a polymeric material and its method of fabrication would fall within the range of process parameters the optimization of which would be well within the capabilities of one of ordinary skill in the appropriate polymer arts. The use of such thermoplastic polyurethanes is well known in downhill ski boots. Polyurethanes of this type possess a range of physical characteristics that are particularly well-suited to the boot 11, in that the polyurethanes are flexible enough to ensure the comfort of the wearer while, at the same time, retaining sufficient durability and stiffness.

The material of which the frame 12 is constructed must be considerably stiffer than the material of the upper boot. By way of example, and without limitation, a suitable polymeric material for the fabrication of the frame 12 is reinforced nylon. According to the method of the present invention, the frame 12 is first fabricated according to methods well within the capability of one of ordinary skill in the appropriate polymer arts. The already-fabricated frame 12 is then positioned within a mold for the boot 11. The widely different physical properties of the polymeric materials used for the frame 12 and the boot 11 that lead to the difference in stiffness of each portion of the in-line skate also make possible the over-molding of the boot material onto and through the frame 12. Due to the polymeric composition of each of the materials used for fabrication of the major components, there will be a relatively significant difference in the glass transition temperatures ($T_g$) for each material. Thus, the structural integrity and form of the frame 12 can be maintained at mold temperatures for the type of softer polymeric material (e.g., polyurethane) used for the boot 11.

The interior shape of the mold for the boot 11 is designed so that, with the pre-fabricated frame 12 in place within the mold, the boot material is permitted to flow within the mold only to and into the over-mold groove 15 around the outer surfaces of the frame 12, defining the over-mold region. At the same time, the polyurethane boot material also flows through the plurality of flow-through apertures 23 defined in the frame walls 20 and sole plate 25 of the frame. This is best illustrated by reference to FIGS. 5 and 6.

Figure 5:
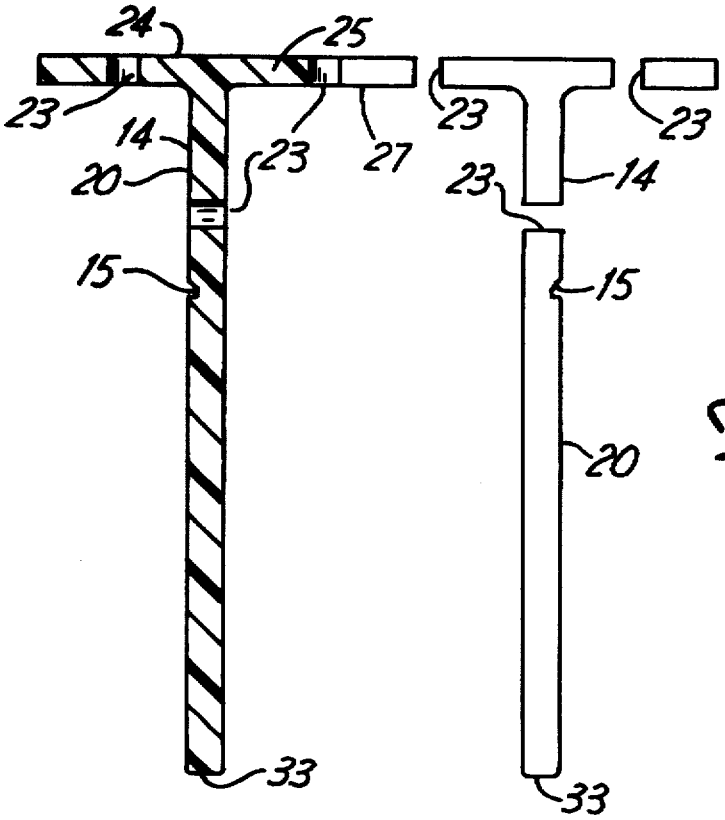
FIG. 5 is an enlarged sectional view of the frame of taken along line 5—5 in FIG. 2.

FIG. 5 is an enlarged sectional view of the frame 12, taken along line 5—5 of FIG. 2. This portion of the frame 12 illustrates the intersection between the sole plate 25 and the downwardly extending frame walls 20 of the frame 12. FIG. 5 also illustrates a plurality of flow-through apertures 23 that extend horizontally through the frame wall 20 and vertically through the sole plate 25. These flow apertures 23 permit the flow of molten polyurethane through the structural elements of the frame 12 from, for example, the upper surface 24 of the sole plate 23, to and along the lower surface 27 of the sole plate 25. Further reference to FIG. 6 illustrates the resulting effect of the flow of polyurethane boot material through the flow-through apertures 23 of the lower frame 12.

Figure 6:
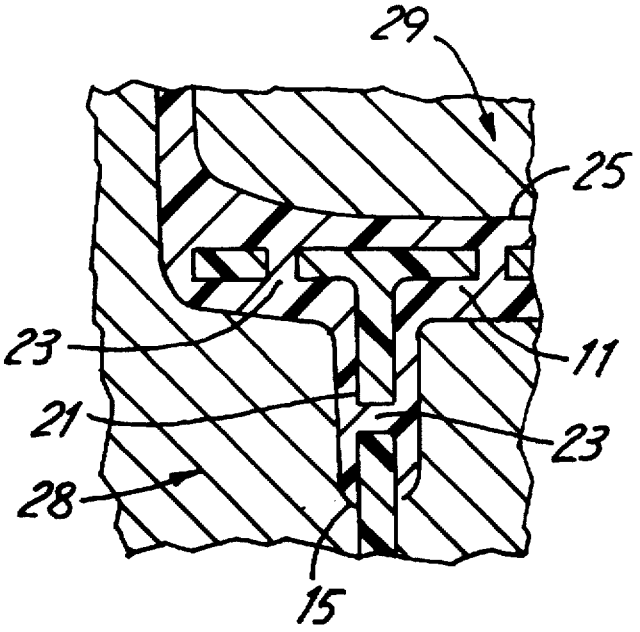
FIG. 6 is an enlarged section, depicting the cross hatched portion of FIG. 5, of the frame after over-molding, with mold elements shown in the broken lines.

FIG. 6 is a further enlarged sectional view with the cross hatched portion of FIG. 5, illustrating the frame 12 after over-molding and with mold elements 28, 29 shown in place. As can be seen in FIG. 6, the frame 12 is positioned within the lower mold element 28 so that the mold volume to be filled with polyurethane boot material extends only to and into the over-mold groove 15 along the outer surfaces of the wall frame 20. FIG. 6 also illustrates the flow of polyurethane through the plurality of flow-through apertures 23 in the frame 12 during the over-molding process. During the over-molding process, the polyurethane within the mold elements 28, 29 is at a temperature in excess of its $T_g$ and the fluid polyurethane flows along the surfaces of the structural elements of the frame 12 and, via the flow-through apertures 23, is caused to flow to and along the opposing surfaces of the structural elements of the frame 12. The end result of this flow of polymeric material is that the polyurethane of the boot 11 substantially encloses the sole plate 25 of the frame 12, and partially encloses the frame walls 20, down as far as the over-mold groove 15.

Structurally, there are significant advantages gained from the over-molding of the material that forms the boot 11 onto and through the frame 12. Principal among these is the creation of a resulting structure that is far more unitary in construction than could be achieved by the prior art methods of separately fabricating the boot 11 and the frame 12 and subsequently fastening the boot 11 and the frame 12 together with conventional fastening means, such as rivets or screws. This degree of unitary construction between the disparate materials of the boot 11 and the frame 12 more readily accommodates the transfer of control forces from the boot 11 to the frame 12, consequently providing the wearer with a degree of control only possible in the prior art with constructions employing one-piece skate designs. This degree of control, more importantly, is achieved without any sacrifice of user comfort due to the use of more flexible materials in the construction of the boot 11.

The general concept of over-molding is not unique to the practice of the present invention. However, experience in the prior art has demonstrated that, where two dissimilar polymeric materials are used in the process, the typical result is a failure to achieve a bonding, whether mechanical or chemical, between the different materials along the surfaces at the interface between the respective materials of the over-mold. This is due to the fundamental differences in the physical properties of the two materials involved. As the over-mold, or second material is allowed to cure within the mold containing the pre-fabricated, or first, structural element, an unavoidable amount of shrinkage of the second material occurs. The extent of the shrinkage will be due primarily to the properties of the specific polymeric material used, although some limitation of the extent of shrinkage can typically be achieved through careful control of process parameters. As the second material cures and shrinks, there is an inevitable pulling away of the second material from the surface of the first material, thus destroying any unity of construction that would be expected to be achieved through the over-molding process.

The presence of the over-mold groove 15 along with the apertures 23 on the frame wall 20, into which the molten polymeric material of the boot 11 is allowed to flow effectively eliminates the undesirable effects associated with shrinkage during curing of the boot material. This is primarily, although not solely, a mechanical phenomenon, in that the material of the boot construction is constrained in more than one dimension during curing by the limits of the over-mold groove 15 and the apertures 23. This largely mechanical constraint prevents the over-mold boot material from separating from the surface of the frame 12 in the over-mold region 14 during curing. In turn, due to the maintenance of intimate contact between the two different materials of the boot 11 and the frame 12, a greater degree of chemical interaction or bonding between the two materials is possible. The end result is a much greater degree of unity of construction for the final assembly, with the attendant benefits discussed above.

Figure 7:
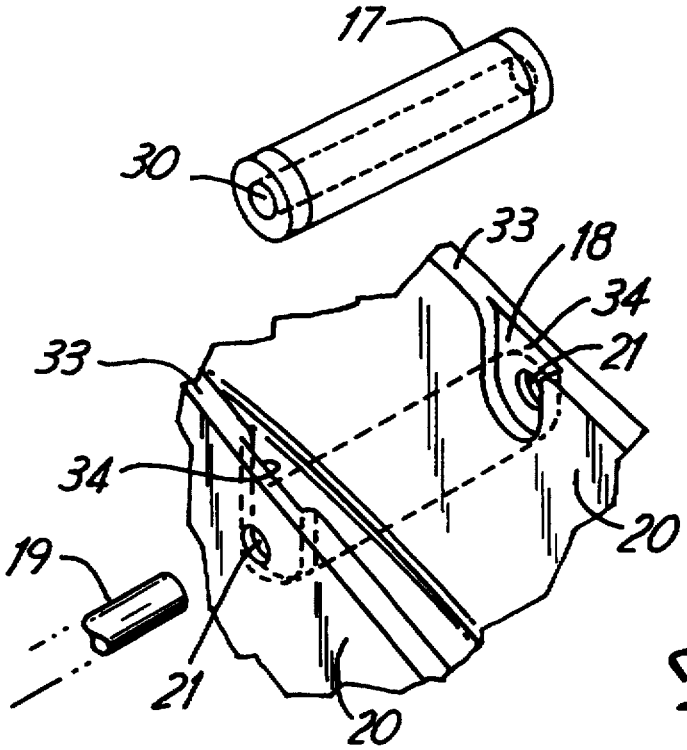
FIG. 7 is a fragmentary exploded perspective view of the frame of the in-line skate of the invention, illustrating the frame in an inverted position, and showing details of roller elements.

Turning now to FIG. 7, there is illustrated a fragmentary exploded perspective view of the frame of the in-line skate of the invention, illustrating the frame in an inverted position, and showing details of the roller elements. The axle seats 18 described above with reference to earlier Figures are plainly illustrated in FIG. 7. The axle seats 18 form recesses on the inner surfaces of the frame walls 20, extending to the bottom margin 33 of the walls 20. The width dimension of the axle seat 18 is slightly greater than the diameter of the roller axle 17. The distance between the back walls 34 of the opposed axle apertures 21 is slightly greater than the length dimension of the roller axles 17. The opposed pair of axle apertures 21 are designed to accommodate the insertion of the roller axle 17 therein.

As shown in FIG. 7, there is an inner diameter to the roller axle 17 that defines an axle bore 30, the diameter of which is designed to approximate the outer diameter of the wheel fastener 19. To assemble a roller wheel 16 into the frame 12, the roller axle 17 is first passed through an accommodating central bore (not shown) of the roller wheel 16. The wheel 16 and axle 17 assembly is then aligned with the bottom margin 33 of a pair of axle seats 18. The ends of the roller axle 17 are inserted into the opposing axle seats 18 in the frame walls 20. When the roller axle 17 is inserted all the way into the axle seats 18, the axle bore 30 aligns with the axle apertures 21 through opposing frame walls 20. Assembly of the roller wheel 16 into the frame 12 is completed by insertion of the wheel fastener 19 through the axle aperture 21 in the frame wall 20 and into the axle bore 30 of the roller axle 17.

The precise form of the wheel fastener 19 is subject to some variation. In its simplest embodiment, the wheel fastener 19 can be a cylindrical element with an outer diameter equal to or slightly greater than the axle bore 30 of the roller axle 17. The fastener 19 is then pressed into the axle bore 30 and held in place by a friction fit. Alternatively, the exterior of the inner end of the wheel fastener 19 is threaded to match a threading on the interior surface of the axle bore 30 so that the fastener 19 is secured to the roller axle 17 by threading into the axle bore 30. These embodiments of the wheel fastener 19 are presented by way of example only, and are not intended to limit in any way the various embodiments possible for the fastener 19. A number of such embodiments of fastening means would be apparent and well within the grasp of one of skill in the appropriate art. However, despite the particular form selected for the wheel fastener 19 of the assembly, it should be apparent from the above description that the present invention provides a simple yet effective design for facile installation and replacement of roller wheels 16 in the in-line roller skate 10.

Although the present invention has been described with reference to preferred embodiments, workers skilled in the art will recognize that changes may be made in form and detail without departing from the spirit and scope of the invention.

What is claimed is:

1. An in-line roller skate comprising:

a boot portion fabricated of a first polymeric material;

a lower frame portion fabricated of a second polymeric material, wherein the frame is characterized by a greater degree of stiffness than the first polymeric material due to the second polymeric material, the frame portion including a sole with an outer edge and two spaced-apart wall portions, each wall portion including a plurality of apertures and wherein the wall portions extend from the sole portion and the outer edge extends beyond the surfaces of each of the wall portions; and wherein the boot and the frame are joined by the first polymeric material being molded over the sole portion and extending over the outer edge and onto outer surfaces of each wall portion and extending into the apertures of each wall portion to bond the boot to the frame sufficiently to endure stresses encountered in skating.

2. The skate of claim 1 wherein the sole portion includes a plurality of apertures.

3. The skate of claim 1 wherein each wall has an outer surface and a continuous groove disposed therein and running the length of the outer surface and wherein the first polymeric material extends from the boot portion and onto the outer surface of the walls to the groove.

4. The skate of claim 1 wherein the first polymeric material has a glass transition temperature that is less than the glass transition temperature of the second polymeric material.

5. A method for forming an in-line roller skate, the method comprising:

providing a skate frame made of a first material;

inserting the skate frame within a mold designed to form a boot portion wherein the frame includes a sole portion with an outer edge and two spaced-apart wall portions, wherein each wall portion includes a plurality of apertures and each wall portion extends from the sole portion and wherein the outer edge extends beyond the surfaces of each wall portion;

injecting a second material that is polymeric, the second material being characterized by being more flexible than the first material, and wherein the second polymeric material is molded over the sole portion and a section of each wall portion and the second polymeric material flowing through the apertures during formation of the boot portion in the mold, the second material extending over and around the outer edge of the sole portion up to the outer surface of the wall portions, the second material solidifying within the apertures such that the boots portion is attached to the skate frame by the second material.

6. The method of claim 5 wherein the sole portion includes a plurality of apertures and wherein the second material flows through the apertures to extend through the apertures once the second material solidifies.

7. The method of claim 5 wherein each wall portion includes an outwardly facing surface, and each surface includes an outwardly facing groove running substantially the length of the wall portion and wherein the mold is designed to permit the second material to flow and solidify around the sole portion and the wall portions up to the groove.

8. The method of claim 5 wherein the first material is polymeric and has a glass transition temperature greater than the second polymeric material.

9. The method of claim 5 wherein the second polymeric material is a thermoplastic.

* * * * *

UNITED STATES PATENT AND TRADEMARK OFFICE

CERTIFICATE OF CORRECTION

PATENT NO. : 5,799,955

DATED : SEPTEMBER 1, 1998

INVENTOR(S) : ROBERT A. IVERSON

It is certified that error appears in the above-identified patent and that said Letters Patent is hereby corrected as shown below:

On the Title Page, below "Assistant Examiner-Michael Cuff", insert --

Attorney, Agent or Firm - Kinney & Lange, P.A.--

Signed and Sealed this

Twenty-sixth Day of October, 1999

*Attest:*

Q. TODD DICKINSON

*Attesting Officer*

*Acting Commissioner of Patents and Trademarks*